US006921284B2

(12) United States Patent
Sirichai et al.

(10) Patent No.: US 6,921,284 B2
(45) Date of Patent: Jul. 26, 2005

(54) ELECTRICAL CONNECTOR

(75) Inventors: Saharut Sirichai, Culver City, CA (US); Ernesto Quinteros, Los Angeles, CA (US)

(73) Assignee: Belkin Corporation, Compton, CA (US)

( * ) Notice: Subject to any disclaimer, the term of this patent is extended or adjusted under 35 U.S.C. 154(b) by 41 days.

(21) Appl. No.: 10/705,172

(22) Filed: Nov. 6, 2003

(65) Prior Publication Data

US 2005/0101180 A1 May 12, 2005

(51) Int. Cl.[7] ..... H01R 3/00
(52) U.S. Cl. ..... 439/490; 439/910
(58) Field of Search ..... 439/490, 910

(56) References Cited

U.S. PATENT DOCUMENTS

| | | | | |
|---|---|---|---|---|
| 1,651,307 A | | 11/1927 | Wilkinson | |
| D238,959 S | | 2/1976 | Kurokawa | |
| D251,687 S | | 4/1979 | Kurokawa | |
| 4,312,507 A | | 1/1982 | Smith et al. | |
| 4,978,317 A | | 12/1990 | Pocrass | |
| 5,034,865 A | | 7/1991 | Sonneman | |
| 5,062,807 A | | 11/1991 | Guss, III | |
| 5,063,486 A | * | 11/1991 | Cummings et al. | 439/237 |
| 5,091,832 A | | 2/1992 | Tortola et al. | |
| 5,091,834 A | | 2/1992 | Kao et al. | |
| 5,122,937 A | | 6/1992 | Stoudemire | |
| 5,122,941 A | | 6/1992 | Gross et al. | |
| 5,130,907 A | | 7/1992 | Tortola et al. | |
| 5,136,477 A | | 8/1992 | Lemmey | |
| 5,172,974 A | | 12/1992 | Riban | |
| 5,183,325 A | | 2/1993 | Hurdle | |
| 5,203,622 A | | 4/1993 | Sottile | |
| 5,217,295 A | | 6/1993 | Tortola et al. | |
| 5,325,280 A | | 6/1994 | Tortola et al. | |
| 5,379,201 A | | 1/1995 | Friedman | |
| D364,000 S | | 11/1995 | Friedman | |
| 5,480,319 A | | 1/1996 | Vlakancic | |
| 5,486,986 A | | 1/1996 | Brada | |
| 5,590,950 A | | 1/1997 | Hildebrand | |
| D377,840 S | | 2/1997 | Chang | |
| 5,601,451 A | | 2/1997 | Driones et al. | |
| 5,613,873 A | | 3/1997 | Bell, Jr. | |
| 5,615,945 A | | 4/1997 | Tseng | |
| 5,684,513 A | | 11/1997 | Decker | |

(Continued)

FOREIGN PATENT DOCUMENTS

| | | |
|---|---|---|
| CN | 89217225 | 2/2002 |
| CN | 02247597.4 | 8/2003 |
| GB | 2113818 A | 8/1983 |
| WO | WO/9206327 | 10/1991 |

OTHER PUBLICATIONS

Internet: DnetStore.com Product Prime-Category Catalog; Apr. 26, 2004; [http://www.dee-inc.com/netstore/catalog/primecategory.asp?MainCategory=Electrical+Recepticles].

(Continued)

*Primary Examiner*—Tho D. Ta
(74) *Attorney, Agent, or Firm*—Bryan Cave LLP

(57) ABSTRACT

An electrical connector (100) includes a housing (110) and a light source (120) inside the housing. The housing has a surface (130). A first portion of the surface permits the passage of a first amount of light from the light source, and a second portion of the surface permits the passage of a second amount of light from the light source, where the second amount of light is different from the first amount of light.

25 Claims, 1 Drawing Sheet

U.S. PATENT DOCUMENTS

| | | | | |
|---|---|---|---|---|
| 5,685,737 | A | 11/1997 | Morin et al. | |
| 5,704,802 | A | 1/1998 | Loudermilk | |
| 5,707,137 | A | 1/1998 | Hon | |
| 5,722,754 | A | 3/1998 | Langner | |
| 5,741,152 | A | 4/1998 | Boutros | |
| 5,803,572 | A | 9/1998 | Brada | |
| D405,798 | S | 2/1999 | Shulman | |
| 5,868,487 | A | 2/1999 | Polley et al. | |
| 5,876,240 | A | 3/1999 | Derstine et al. | |
| 5,899,553 | A | 5/1999 | Howell | |
| D418,240 | S | 12/1999 | Sherman | |
| 6,089,893 | A * | 7/2000 | Yu et al. | 439/225 |
| 6,116,946 | A | 9/2000 | Lewis et al. | |
| 6,145,992 | A | 11/2000 | Wattenburg | |
| D435,679 | S | 12/2000 | Naghi et al. | |
| 6,161,944 | A | 12/2000 | Leman | |
| 6,165,006 | A | 12/2000 | Yeh et al. | |
| 6,168,292 | B1 | 1/2001 | Sherman | |
| 6,186,636 | B1 | 2/2001 | Naghi et al. | |
| 6,217,371 | B1 | 4/2001 | Wu | |
| 6,227,911 | B1 | 5/2001 | Boutros et al. | |
| 6,257,906 | B1 * | 7/2001 | Price et al. | 439/490 |
| 6,260,984 | B1 | 7/2001 | Naghi et al. | |
| 6,273,581 | B1 | 8/2001 | Neiser | |
| 6,290,533 | B1 | 9/2001 | Major | |
| 6,318,873 | B1 | 11/2001 | Naghi et al. | |
| 6,319,051 | B1 | 11/2001 | Chang et al. | |
| D452,026 | S | 12/2001 | Naghi et al. | |
| 6,334,787 | B1 | 1/2002 | Chang | |
| 6,354,884 | B1 | 3/2002 | Yeh et al. | |
| 6,361,357 | B1 | 3/2002 | Stillwell et al. | |
| 6,409,530 | B1 | 6/2002 | Zhao et al. | |
| 6,431,906 | B1 | 8/2002 | Belopolsky | |
| 6,433,445 | B1 | 8/2002 | Ahladas et al. | |
| 6,454,595 | B1 | 9/2002 | Espenshade | |
| 6,457,993 | B1 | 10/2002 | Espenshade | |
| 6,464,533 | B1 | 10/2002 | Ma et al. | |
| 6,478,610 | B1 | 11/2002 | Zhou et al. | |
| 6,478,611 | B1 | 11/2002 | Hyland | |
| 6,483,712 | B1 | 11/2002 | Oliphant et al. | |
| 6,488,529 | B1 | 12/2002 | Chen | |
| 6,490,163 | B1 * | 12/2002 | Pua et al. | 361/784 |
| 2001/0027055 | A1 | 10/2001 | Laity et al. | |
| 2001/0039140 | A1 | 11/2001 | Fasold et al. | |
| 2001/0043468 | A1 | 11/2001 | Krietzman et al. | |
| 2002/0009920 | A1 * | 1/2002 | Wijma et al. | 439/502 |
| 2003/0045160 | A1 | 3/2003 | Chen | |
| 2004/0042735 | A1 * | 3/2004 | Ma | 385/88 |

OTHER PUBLICATIONS

Internet: RadioShack.ca Cool New Gadgets; Apr. 26, 2004; [http://www.radioshack.ca/estore/Product.aspx?language+en-CA&product=2600196&category].

Internet: Delphi Connection Systems Product Manual, [http://www.delphi.com/pdf/delphiconnect/products/PS_USB_02%20Rev.%2002.pdf].

*USB A/M to B/M With LED*; Drawing No. C520742E; Mar. 20, 2003.

Internet: Delphi USB Cables ; Apr. 26, 2004 [http://shopdelphi.com/products/consumers/usbcables/?print=1&].

ecfilm.net. Description of DICOTANotebook Light product [online], [retrieved on Jan. 30, 2003]. Retrieved from the Internet; <URL:http//www.ecfilm.net/shopnblight.html>.

M and S Plus Corp. Description of USB Notebook Light product [online], [retrieved on Jan. 30, 2003], Retrieved from the Internet. <URL:http//www.symmic.com/product.asp?3=57>.

Nobrand. Description of USB Notebook Light product [online], [retrieved on Jan. 30, 2003], Retrieved from the Internet. <URL:http://vtama.com/shopu/usblight/>.

911ForPCs.com. Description of Kensington 62641 USB Notebook Light Flylight product [online], [retrieved on Jan. 30, 2003], Retrieved from the Internet. <URL://http://www.911forpcs.com/usbnotligfly.html>.

Internet. *Lewis N. Clark Travel Solutions*; [http://www.lewisnclark.com/products/products.asp?ProductID=1209&CatID=306]; Oct. 6, 2003.

Internet. *Targus*; [http://www.targus.com/us/product_details.asp?sku=PA015U]; Oct. 3, 2003.

Internet. *Targus*; [http://www.targus.com/us/product_details.asp?sku=PA017U]; Oct. 3, 2003.

Internet: Kensington Mobile Accessories: Laptop: [http://www.kensington.com/1421.html]; Jan. 30, 2003.

* cited by examiner

ELECTRICAL CONNECTOR

FIELD OF THE INVENTION

This invention relates generally to electrical signal transmission, and relates more particularly to electrical connectors.

BACKGROUND OF THE INVENTION

Electrical connectors of many descriptions have been produced in order to enable electrical signal transmission among various electronic components. Some electrical connectors are made to light up under certain conditions; these electrical connectors are referred to herein as lighted electrical connectors. Lighted electrical connectors can provide a number of advantages over electrical connectors that are not lighted. An as example, lighted electrical connectors can offer confirmation that an electrical connection has been made. As another example, a lighted electrical connector can be easier to find than a non-lighted electrical connector, especially in an area with poor or low lighting. As yet another example, lighted electrical connectors can be more decorative or aesthetically pleasing than non-lighted electrical connectors.

Existing lighted electrical connectors, however, are flawed in that much of the available light is lost to internal reflection, and in that they are only capable of providing light at a uniform intensity at all regions of the lighted electrical connector. Accordingly, there exists a need for a lighted electrical connector that reduces the light lost to internal reflection, and that is capable of providing different levels of illumination at different regions.

BRIEF DESCRIPTION OF THE DRAWINGS

The invention will be better understood from a reading of the following detailed description, taken in conjunction with the accompanying figures in the drawings in which.

Figure 1:
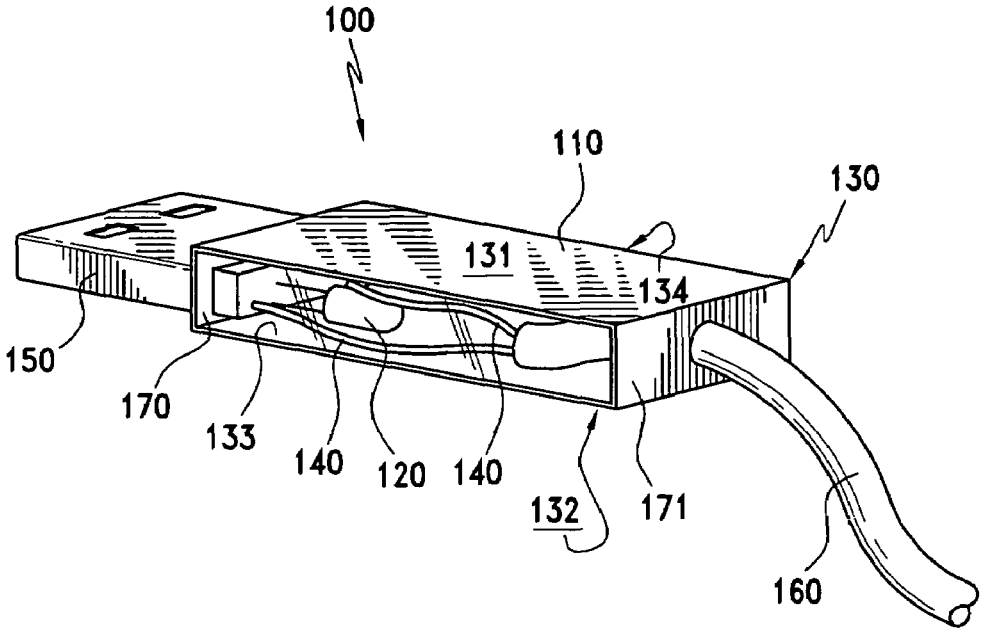
FIG. 1 is an isometric view of an electrical connector according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner.

DETAILED DESCRIPTION OF THE DRAWINGS

In one embodiment of the invention, an electrical connector comprises a housing and a light source inside the housing. The housing has a surface. A first portion of the surface permits the passage of a first amount of light from the light source, and a second portion of the surface permits the passage of a second amount of light from the light source, where the second amount of light is different from the first amount of light.

FIG. 1 is an isometric view of an electrical connector 100 according to an embodiment of the invention. As illustrated in FIG. 1, electrical connector 100 comprises a housing 110 and a light source 120 inside housing 110. As an example, light source 120 can be a light emitting diode (LED). Housing 110 has a surface 130. In the illustrated embodiment, housing 110 has a rectangular shape; however, in other embodiments, housing 110 can have other forms or shapes. As an example, housing 110 can have an oval, or football, shape. As another example, housing 110 can have a wedge or pyramid-like shape. As yet another example, housing 110 can be shaped like a cube, or like an elongated cube.

Electrical connector 100 further comprises wires 140 inside housing 110 and a connector tip 150 partially enclosed within housing 110 at an end 170 of housing 110. In one embodiment, connector tip 150 comprises an opaque metal shell. In the same or another embodiment, connector tip 150 is a universal serial bus (USB) connector tip. As an example, connector tip 150 can be a USB A or a USB B connector tip. In another embodiment, connector tip 150 is a firewire connector tip. As an example, connector tip 150 can be a four-pin or a six-pin firewire connector tip. A cable 160 passes through an end 171 of housing 110 and into housing 110. End 171 is opposite end 170.

A first portion of surface 130 permits the passage of a first amount of light from light source 120, and a second portion of surface 130 permits the passage of a different amount of light from light source 120. In one embodiment, this difference in the amount of light admitted by the first and second portions of surface 130 is due to the fact that the first portion and the second portion are constructed of different materials. As an example, the first portion can be constructed of plastic and the second portion can be constructed of glass. As another example, the first portion can be constructed of a thicker layer of a first plastic and the second portion can be constructed of a thinner layer of a second plastic.

In another embodiment, each of the first and second portions are constructed from the same material. As a first example, the first and second portions can comprise different thicknesses of the same plastic. As a second example, the difference in the amount of light admitted is due to the fact that the first portion is textured or translucent while the second portion is non-textured or transparent. In one embodiment of this second example, the first portion can be textured with texture number MT11070 from the Visual Texture Standards Book published by Mold-Tech, and the second portion can be a clear-polished portion. As an example, the material from which the first and second portions are constructed can be an elastomer or a semi-rigid plastic resin. As a particular example, the material can be a transparent grade of polyvinyl chloride (PVC). Transparent-grade PVC is cost-effective and is flexible enough to allow an effective strain relief to be molded into housing 110.

In one embodiment, housing 110 can be formed using injection molding techniques. As an example, PVC or another suitable material can be molded around light source 120, around wires 140, around a portion of connector tip 150, and around a portion of cable 160, such that light source 120, wires 140, the portion of connector tip 150, and the portion of cable 160 are contained within, encased by, and/or encapsulated by housing 110 and such that no air gaps are present within housing 110. In one embodiment, the second portion can be clear-polished as part of the injection molding process, rather than in a separate polishing step. In the same or another embodiment, the first portion can be textured in a separate texturing step, rather than as part of the injection molding process.

A light beam incident upon a light-admitting surface will be partially transmitted through the surface and partially reflected away from the surface. More specifically, the incident light beam splits into a transmitted beam and a reflected beam, with the relative proportions of each beam compared to the original light beam being influenced by, among other parameters, the light beam's angle of incidence. For angles of incidence above what is known as the critical angle, all of the incident light will be reflected, and none transmitted. Such an occurrence is known as total internal reflection. A textured or translucent surface, by decreasing the likelihood that a light beam will strike the surface at or above the critical angle, decreases the likelihood that total internal reflection will occur. In other words, a textured surface will allow more light to pass through it than will a non-textured surface.

Referring still to FIG. 1, surface 130 of electrical connector 100 comprises a side 131, a side 132 substantially opposite side 131, a side 133 extending between side 131 and side 132, and a side 134 substantially opposite side 133 and extending between side 131 and side 132. In one embodiment, side 131 is substantially parallel to side 132. In the same or another embodiment, side 133 is substantially parallel to side 134. In the same or another embodiment, at least portions of sides 131 and 132 and ends 170 and 171 form the first portion of surface 130, and at least portions of sides 133 and 134 form the second portion of surface 130. Accordingly, in the embodiment illustrated in FIG. 1, side 133 is illustrated to be transparent.

As alluded to briefly above, in a first embodiment sides 131 and 132 are textured as previously described herein, while sides 133 and 134 are clear-polished, also as previously described herein. Accordingly, more light from light source 120 will pass through sides 131 and 132 than will pass through sides 133 and 134, thus increasing visibility and light intensity at sides 131 and 132 over the visibility and light intensity of sides 133 and 134. Sides 131 and 132 are thus readily distinguishable from sides 133 and 134. In a second embodiment, each of sides 131, 132, 133, and 134 can be textured as described above, thus increasing visibility and light intensity over that of an electrical connector having a non-textured housing. In a third embodiment, at least portions of sides 131 and 132 are textured as previously described herein, while at least portions of sides 133 and 134 are clear-polished, also as previously described herein. Accordingly, more light from light source 120 passes through the textured portions of sides 131 and 132 than passes through the clear-polished portions of sides 133 and 134, thus increasing visibility and light intensity at the textured portions of sides 131 and 132 over the visibility and light intensity of the clear-polished portions of sides 133 and 134. The textured portions of sides 131 and 132 are thus readily distinguishable from the clear-polished portions of sides 133 and 134. As an example of this third embodiment, a logo, a letter, a series of letters, or some other symbol or group of symbols can be textured such that the symbol or group of symbols are characterized by increased visibility and light intensity, as described.

Figure 2:
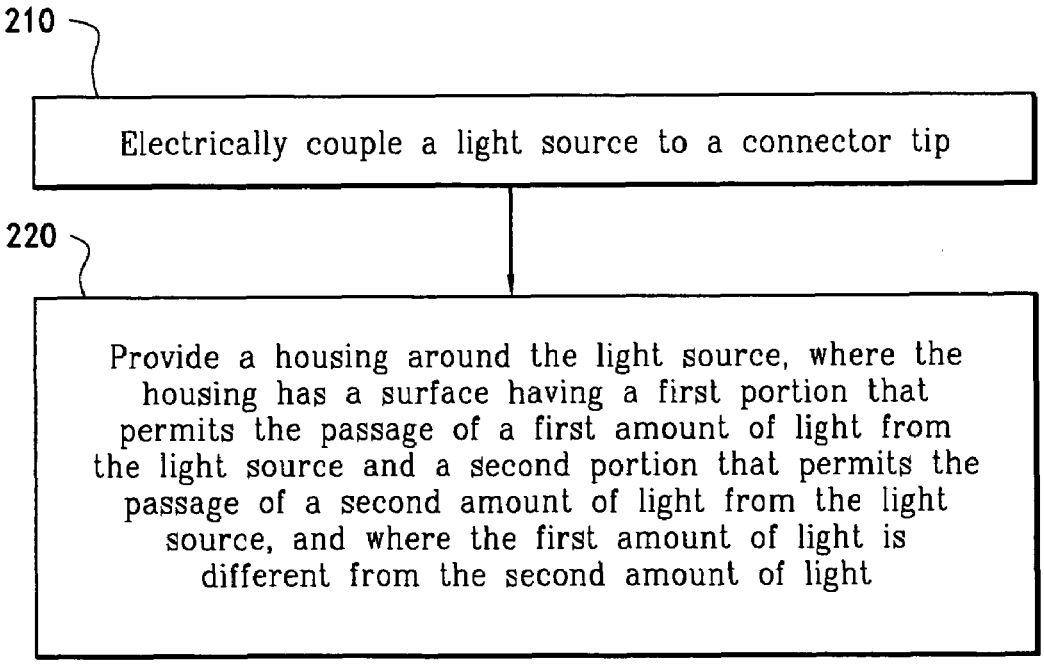
FIG. 2 is a flowchart illustrating a method of manufacturing an electrical connector according to an embodiment of the invention.

FIG. 2 is a flowchart illustrating a method 200 of manufacturing an electrical connector according to an embodiment of the invention. A step 210 of method 200 is to electrically couple a light source to a connector tip. As an example, the light source can be similar to light source 120 in FIG. 1. As another example, the connector tip can be similar to connector tip 150 in FIG. 1.

A step 220 of method 200 is to provide a housing around the light source, where the housing has a surface having a first portion that permits the passage of a first amount of light from the light source and a second portion that permits the passage of a second amount of light from the light source, where the first amount of light is different from the second amount of light. As an example, the housing can be similar to housing 110 in FIG. 1. As another example, the surface can be similar to surface 130 in FIG. 1. As still another example, the first portion can comprise at least portions of sides 131 and 132 and ends 170 and 171, which sides and ends are shown in FIG. 1, and the second portion can comprise at least portions of sides 133 and 134, which sides are also shown in FIG. 1.

In one embodiment, step 220 or another step can further comprise providing the first portion to be textured and/or providing the second portion to be polished. In the same or another embodiment, step 220 or another step can further comprise providing the first portion and the second portion to be constructed of an elastomer or a semi-rigid plastic resin, such as a transparent grade of PVC. In the same or another embodiment, step 210 or another step can further comprise providing the connector tip to be one of a USB connector tip and a firewire connector tip.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the electrical connector discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. An electrical connector comprising:
a housing having a surface comprising:
a first side;
a second side substantially opposite the first side;
a third side extending between the first side and the second side; and
a fourth side substantially opposite the third side and extending between the first side and the second side;
a connector tip partially enclosed within the housing and having a portion extending from the housing; and
a light source entirely contained within the housing,
wherein:
a first portion of the surface permits the passage of a first amount of light from the light source;
a second portion of the surface permits the passage of a second amount of light from the light source;
the first side and the second side form the first portion;
the third side and the fourth side form the second portion; and
the second amount of light is different from the first amount of light.

2. The electrical connector of claim 1 further comprising:
a plurality of wires inside the housing,
wherein:
the connector tip is selected from the group consisting of a universal serial bus connector tip and a firewire connector tip.

3. The electrical connector of claim 1 wherein:
the light source is a light emitting diode.

4. The electrical connector of claim 1 wherein:
the first amount of light is greater than the second amount of light.

5. The electrical connector of claim 4 wherein:
the first portion is textured; and
the second portion is non-textured.

6. The electrical connector of claim 4 wherein:
the first portion is translucent; and
the second portion is transparent.

7. The electrical connector of claim 4 wherein:
the first portion is constructed of a first material;
the second portion is constructed of a second material; and
the second material is different from the first material.

8. The electrical connector of claim 4 wherein:
the first portion is constructed of a first material; and
the second portion is constructed of the first material.

9. An electrical connector comprising:
a housing having a surface comprising:
a first side;
a second side substantially opposite the first side;
a third side extending between the first side and the second side; and
a fourth side substantially opposite the third side and extending between the first side and the second side; and
a light source inside the housing,
wherein:
at least portions of the first side and the second side form a first portion of the surface;
at least portions of the third side and the fourth side form a second portion of the surface; and
more light passes through the first portion than passes through the second portion.

10. The electrical connector of claim 9 wherein:
the first side is substantially parallel to the second side; and
the third side is substantially parallel to the fourth side.

11. The electrical connector of claim 9 wherein:
the first portion is textured; and
the second portion is polished.

12. The electrical connector of claim 11 wherein:
the first portion is constructed of a first material;
the second portion is constructed of a second material; and
the second material is different from the first material.

13. The electrical connector of claim 11 wherein:
the first portion is constructed of a first material; and
the second portion is constructed of the first material.

14. The electrical connector of claim 13 wherein:
the first material is polyvinyl chloride.

15. The electrical connector of claim 9 further comprising:
a plurality of wires inside the housing; and
a connector tip partially enclosed within the housing,
wherein:
the connector tip is selected from the group consisting of a universal serial bus connector tip and a firewire connector tip.

16. The electrical connector of claim 15 wherein:
the light source is a light emitting diode.

17. An electrical connector comprising:
a housing having a surface comprising:
a first side;
a second side substantially opposite and substantially parallel to the first side;
a third side extending between the first side and the second side; and
a fourth side substantially opposite and substantially parallel to the third side and extending between the first side and the second side; and
a light emitting diode inside the housing,
wherein:
at least a portion of the first side and at least a portion of the second side form a first portion of the surface;
at least a portion of the third side and at least a portion of the fourth side form a second portion of the surface;
the first portion is textured; and
more light passes through the first portion than passes through the second portion.

18. The electrical connector of claim 17 wherein:
the second portion is polished.

19. The electrical connector of claim 18 wherein:
the first portion and the second portion are constructed of a transparent grade of polyvinyl chloride.

20. The electrical connector of claim 19 further comprising:

a plurality of wires inside the housing; and a connector tip partially enclosed within the housing, wherein:

the connector tip is selected from the group consisting of a universal serial bus connector tip and a firewire connector tip.

21. A method of manufacturing an electrical connector, the method comprising:

electrically coupling a light source to a connector tip; and providing a housing around the light source, the housing having a surface, surface comprising:

a first side;

a second side substantially opposite the first side;

a third side extending between the first side and the second side; and a fourth side substantially opposite the third side and extending between the first side and the second side;

wherein:

a first portion of the surface permits the passage of a first amount of light from the light source;

a second portion of the surface permits the passage of a second amount of light from the light source;

the first side and the second side form the first portion;

the third side and the fourth side form the second portion; and the second amount of light is different from the first amount of light.

22. The method of claim 21 further comprising:

providing the first portion to be textured; and providing the second portion to be polished.

23. The method of claim 21 further comprising:

providing the connector tip to be one of a universal serial bus connector tip and a firewire connector tip.

24. The method of claim 21 further comprising:

providing the first portion and the second portion to be constructed of a material selected from the group consisting of an elastomer or a semi-rigid plastic resin.

25. The method of claim 24 further comprising:

providing the first portion and the second portion to be constructed of a transparent grade of polyvinyl chloride.

* * * * *